US009865958B2

(12) United States Patent
Beischer

(10) Patent No.: US 9,865,958 B2
(45) Date of Patent: Jan. 9, 2018

(54) PLUG

(71) Applicant: HARTING Electric GmbH & Co. KG, Espelkamp (DE)

(72) Inventor: Thomas Beischer, Espelkamp (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/312,122

(22) PCT Filed: Jul. 1, 2015

(86) PCT No.: PCT/DE2015/100272
§ 371 (c)(1),
(2) Date: Nov. 17, 2016

(87) PCT Pub. No.: WO2016/000691
PCT Pub. Date: Jan. 7, 2016

(65) Prior Publication Data

US 2017/0110824 A1 Apr. 20, 2017

(30) Foreign Application Priority Data

Jul. 4, 2014 (DE) ..... 10 2014 109 351

(51) Int. Cl.
*H01R 13/512* (2006.01)

(52) U.S. Cl.
CPC ..... *H01R 13/512* (2013.01)

(58) Field of Classification Search
CPC .... H01R 24/64; H01R 25/006; H01R 13/518; H01R 13/6658; H01R 13/514; H01R 13/659; H01R 31/06; H01R 13/6461; H01R 13/506; H01R 13/6666; H01R 13/719; H01R 13/6275; H01R 13/65802; H01R 13/6598
See application file for complete search history.

(56) References Cited

U.S. PATENT DOCUMENTS 6,379,181 B1 * 4/2002 Chang ..... H01R 12/7029 439/567
8,147,273 B2 4/2012 Rabbe et al. ..... 439/607.06
8,668,530 B2 3/2014 Riepe et al. ..... 439/701
(Continued)

FOREIGN PATENT DOCUMENTS

DE 2033011 1/1972 ..... H01R 13/655
DE 102005019245 3/2007 ..... H01R 13/506
(Continued)

OTHER PUBLICATIONS

German Office Action issued in application No. 10 2014 109 351.8, dated Mar. 2, 2015 (2 pgs).
(Continued)

*Primary Examiner* — Truc Ngyuen
(74) *Attorney, Agent, or Firm* — Hayes Soloway P.C.

(57) ABSTRACT

Provided is a plug to be mechanically and electrically connected to a corresponding mating plug, comprising a housing, a protective conductor bridge, a retaining frame, and a plug insert; the retaining frame is mounted on the housing and includes at least one connecting section to be connected to the plug insert, and the plug insert is mounted on the at least one connecting section; the protective conductor bridge is laterally inserted into the retaining frame.

23 Claims, 4 Drawing Sheets

(56) References Cited

U.S. PATENT DOCUMENTS

| | | | | |
|---|---|---|---|---|
| 8,900,018 | B2 | 12/2014 | Riepe et al. | H01R 13/52 |
| 9,368,919 | B2 | 6/2016 | Diessel et al. | H01R 13/655 |
| 2005/0148218 | A1* | 7/2005 | Fang | H01R 13/514 439/79 |
| 2008/0090455 | A1* | 4/2008 | Zhu | H01R 13/508 439/567 |
| 2013/0084742 | A1* | 4/2013 | Wang | H01R 13/6658 439/607.28 |
| 2013/0157478 | A1* | 6/2013 | Naufel | H01R 12/7082 439/59 |
| 2013/0189879 | A1* | 7/2013 | Kondo | H01R 9/18 439/607.44 |
| 2013/0217268 | A1 | 8/2013 | Duan et al. | 439/660 |
| 2013/0316572 | A1* | 11/2013 | Ishikawa | H01R 13/621 439/569 |
| 2014/0106619 | A1* | 4/2014 | Okamoto | H01R 13/6581 439/607.58 |
| 2014/0242840 | A1* | 8/2014 | Dang | H01R 13/6461 439/607.01 |
| 2014/0377978 | A1* | 12/2014 | Okamoto | H01R 13/5202 439/345 |

FOREIGN PATENT DOCUMENTS

| | | | |
|---|---|---|---|
| DE | 202009007276 | 10/2010 | H01R 13/502 |
| DE | 102012101813 | 6/2013 | H01R 13/502 |
| JP | 2006190620 | 7/2006 | H01R 13/514 |
| WO | WO2011069522 | 6/2011 | H01R 13/518 |

OTHER PUBLICATIONS

International Search Report (w/translation) and Written Opinion (no translation) issued in application No. PCT/DE2015/100272, dated Oct. 19, 2015 (11 pgs).

International Preliminary Report on Patentability issued in application No. PCT/DE2015/100272, dated Jan. 10, 2017 (10 pgs).

* cited by examiner

PLUG

BACKGROUND OF THE INVENTION

Plug connectors and mating plug connectors are used in the prior art in order to produce an electrical and mechanical connection between two electrical lines or an electrical line and a device or an installation. In particular, large, heavy plug connectors are required to transfer large currents, said large, heavy plug connectors being protected by means of the housing against environmental influences.

Housings of this type are typically embodied from aluminum and are provided with a thread for receiving a cable screw. The plug connectors under consideration in this case are embodied so as to connect a plurality of electrical conductors, one of which is a protective conductor (PE contact). The protective conductor can also be embodied combined with a neutral conductor as a PEN contact. The protective conductor is connected to the protective conductor bridge in order to render possible a corresponding protective conductor function and to bring the protective conductors of the plug connector and mating plug connector into contact with one another. The remaining conductors are connected to electrical contacts of the plug insert.

The fundamental construction of the plug connector and mating plug connector can essentially be identical and can merely differ in the embodiment of their electrical contacts for producing the electrical connection. The embodiments for the plug connector consequently accordingly apply for the mating plug connector.

Plug connectors and mating plug connectors are accordingly embodied in accordance with the plug-socket principle for producing an electrical connection between the plug connector and the mating plug connector. The electrical contacts of plug connector and mating plug connector can be embodied in each case accordingly as contact pins or contact pin receiving arrangements. The plug insert is fixedly positioned on the housing to safely electrically connect the conductors of the plug connector and mating plug connector.

PRIOR ART

DE 203 30 11 A discloses a protective contact plug of this type having a plug insert that is arranged in a plug jacket in which the protective contact is fastened directly on the contact carrier of the plug insert.

DE 10 2005 019 245 B3 discloses an electrical plug apparatus in accordance with EN 60 309 and a protective contact plug apparatus comprising a contact carrier and a surrounding housing. The surrounding housing is used to receive and fasten the contact carrier that comprises latching elements that produce a latched, non-positive and/or positive locking connection with the surrounding housing when axially inserting into the surrounding housing. The latching arrangement can be detached by means of actuating one or multiple unlocking elements that are located on the surrounding housing.

The above described plug connector is disadvantageous in that the assembly of the protective conductor bridge and the plug insert is complex and it is necessary to leave assembly space in the housing in order to assemble both the plug insert as well as the protective conductor bridge. As a consequence, it is necessary to embody the plug connector in an accordingly large manner. Moreover, plug connectors of this type are often heavy which makes handling them difficult.

Based on these disadvantages, DE 10 2012 101 813 B3 discloses a plug connector of the above mentioned type that is simple and cost-efficient to produce, easy to handle and renders possible a secure mechanical and electrical connection of the plug connector and mating plug connector.

SUMMARY OF THE INVENTION

The object of the present invention resides in offering a workaround solution to the invention in DE 10 2012 101 813 B3. Moreover, the stability of the plug insert is to be improved in the plug connector.

The invention relates to a plug connector for mechanically and electrically connecting to a corresponding mating plug connector. Plug connectors and mating plug connectors can be embodied in an identical manner. The plug connector can be provided both as a cable plug connector for connecting to a cable or as a mounting connector for assembling on a device wall.

The plug connector comprises a housing in which a holding frame is received. The holding frame is used to receive a plug insert. The plug insert is provided so as to electrically contact a corresponding plug insert of the mating plug connector.

Moreover, a protective conductor bridge is provided in the plug connector, said protective conductor bridge being used to connect the protective conductors (PE-contacts) of the plug insert.

For this purpose, the protective conductor bridge is inserted in accordance with the invention laterally into the holding frame. The protective conductor bridge is expediently produced from an electrically conductive material. A particularly preferred embodiment of the protective conductor bridge provides that said protective conductor bridge is embodied from sheet metal. This is particularly flexible, easy to work with and cost-effective.

At least one connecting region is provided on the holding frame in order to be able to fasten the plug insert in the holding frame. The plug insert can be held on the holding frame on said at least one connecting region. The connecting region is expediently embodied on the holding frame in such a manner that the plug insert can be fastened by means of a screw connection on the holding frame.

In accordance with the invention, for this purpose the connecting region comprises a through-going hole on the holding frame into which a screw can be inserted. For this purpose, the through-going hole is provided on its inner side with an inner thread.

In a particular embodiment, a sleeve is inserted into the connecting region of the holding frame that is embodied as a screw sleeve. This screw sleeve is attached in a rotationally-secure manner in the connecting region. A screw with which a plug insert is fastened to the holding frame can thus be screwed into the screwing sleeve in the connecting region. It is particularly expedient to embody the screwing sleeve from metal in order to ensure a secure fastening arrangement and screwing arrangement.

In a preferred embodiment, the protective conductor bridge comprises at least one link, wherein the link comprises a through-going hole. The through-going hole is provided in the link in such a manner that the through-going hole lies symmetrical in a circular manner with respect to the through-going hole of the connecting region of the holding frame.

For this purpose, the link is preferably inserted into a slot that is aligned transverse with respect to the through-going hole of the connecting region. As a consequence, the link likewise lies transverse with respect to the through-going hole of the connecting region and the through-going holes can be aligned flush and symmetrical in a circular manner.

In a particularly preferred embodiment, at least one pair of two parallel links are provided on the protective conductor bridge. The two links comprise in each case a through-going hole, wherein the through-going holes of the links are arranged symmetrical in a circular manner.

In the case of this embodiment, at least one of the two links is provided in a slot in the holding frame. The second link is arranged on the connecting region in such a manner that said second link contacts the plug insert. An electrically conductive connection is produced between the plug insert and the protective conductor bridge by means of screwing the plug insert into the connecting region.

A following embodiment provides that the screwing sleeve be provided in the connecting region of the holding frame in such a manner that said screwing sleeve at least penetrates a through-going hole of a link. The screwing sleeve is to be guided though the through-going hole of the link in a particularly expedient manner, said link being inserted into the holding frame. The link can thus be inserted into the slot and subsequently can be secured against falling out by means of the screwing sleeve that penetrates the through-going hole.

In a further preferred embodiment of the present invention, the protective conductor bridge comprises two pairs of links. The pairs of links are provided on the end regions of the protective conductor bridge that is embodied in a longitudinal manner. Accordingly, in this embodiment the holding frame comprises two connecting regions into which the links can be inserted.

In accordance with the invention, the holding frame comprises fastening means that are provided for the purpose of fastening the holding frame in the housing of the plug connector. The fastening means are preferably embodied as latching means. As a consequence, the holding frame can latch in the housing of the plug connector. Corresponding latching means in the housing provide a secure and permanent latching arrangement of the fastening means of the holding frame in the housing.

In a preferred embodiment, multiple fastening means are provided on the holding frame in opposite-lying alignments. In the case of housings that are embodied as attachment housings, a further positive effect is also rendered possible by means of the opposing aligned fastening means. Attachment housings are housings that do not comprise a cable output but rather can be attached to a housing wall or device wall.

In the case of these housings, the holding frame can be inserted from both sides into the housing by means of the opposing-aligned fastening means. In other words, both from the plugging side of the housing as well as from the connecting side.

The advantages of the invention then come particularly into their own if the housing of the plug connector is a housing embodied from a synthetic material. A latching arrangement of the holding frame that is likewise produced from synthetic material is particularly advantageous and easy to achieve. The fastening means of the holding frame and also the corresponding latching means in the housing represent a particularly good and permanent connection if all the components are produced from synthetic material.

BRIEF DESCRIPTION OF THE DRAWINGS

An exemplary embodiment of the invention is further illustrated in the drawings and is further explained hereinunder. In the drawings.

The figures include in part simplified, schematic illustrations. To some extent, identical reference numerals are used for identical but where appropriate non-identical elements. Various views of the same elements could be scaled differently.

DETAILED DESCRIPTION OF THE INVENTION

Figure 1:
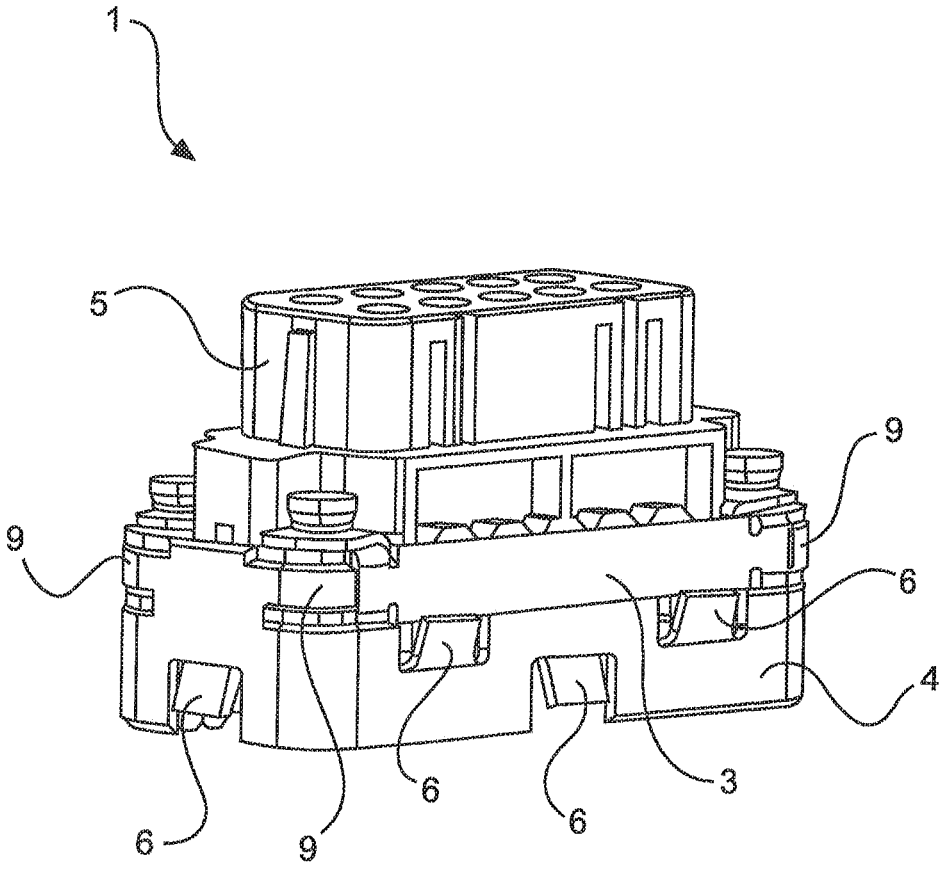
FIG. 1 illustrates a perspective view of a plug connector without a housing.

FIG. 1 illustrates a perspective view of a plug connector 1 in accordance with the invention. A holding frame 4, a plug insert 5 and a protective conductor bridge 3 are illustrated. A housing 2 that surrounds said components is not illustrated in FIG. 1.

The holding frame 4 comprises in each case a connecting region 9 in its four corners. This is provided so as to fasten the plug insert 5. For this purpose, the plug insert 5 is securely screwed using four screws in the connecting region 9 and is thus held on said connecting region.

Fastening means 6 are provided distributed over the outer side of the holding frame 4. These fastening means 6 that are embodied as latching means are used so as to latch the holding frame 4 in a housing 2. Expediently, multiple fastening means 6 are aligned in opposing directions in order to avoid said holding frame falling out as well as to avoid further penetration into the housing 2.

The protective conductor bridge 3 is inserted into the holding frame 4 on its longitudinal side. The main body of the protective conductor bridge 3 lies on the holding frame 4, wherein the end regions of the protective conductor bridge 3 engage into the connecting regions 9 of the holding frame 4. Moreover, a contacting arrangement between the protective conductor bridge 3 and the plug insert 5 is ensured in the connecting regions 9.

Figure 2:
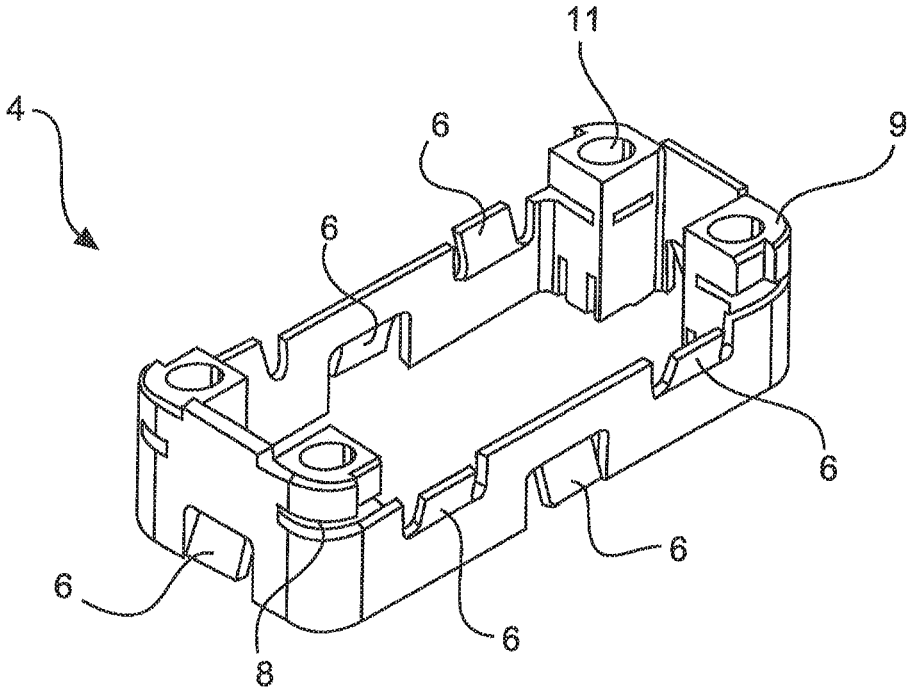
FIG. 2 illustrates a perspective view of a holding frame.

FIG. 2 illustrates a single holding frame 4 in a perspective view. The frame-shaped base structure of the holding frame 4 is evident. The fastening means 6 are again illustrated on the longitudinal sides, and also on the transverse sides, said fastening means being used to latch the holding frame 4 in a housing 2.

It is possible to ensure a secure fastening and latching arrangement of the holding frame 4 in a housing 2 by means of the latching means that are aligned in opposing directions.

The connecting regions 9 are provided in the corner regions of the holding frame 4. The connecting regions 9 are formed by means of through-going holes 11 in which a plug insert 5 can be fastened.

Moreover, a slot 8 is provided in each connecting region 9. Said slot is aligned transverse with respect to the through-going holes 11 so that in each case a slot 8 intersects a through-going hole in a perpendicular manner.

Figure 3:
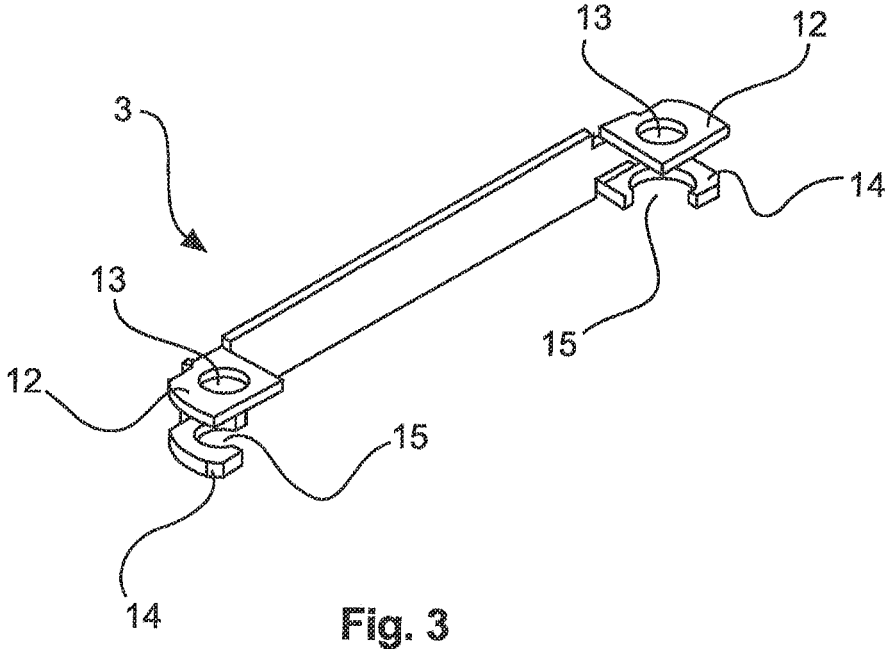
FIG. 3 illustrates a perspective view of a protective conductor bridge.

An individual protective conductor bridge 3 in accordance with the invention is illustrated in a perspective view in FIG. 3. In each case, a pair of links 12, 14 are formed on the longitudinal base body. The links 12, 14 are aligned parallel to one another.

A through-going hole 13, 15 is provided in each of the links 12, 14. The through-going holes 13, 15 are aligned symmetrical in a circular manner and flush. The links 14 are used for inserting into the slots 8 of the holding frame 4. The links 12 are provided so as to lie on the connecting regions 9 in order to make electrical contact at that location with an attached plug insert.

The through-going holes 13, 15 of the protective conductor bridge 3 and the through-going hole 11 of the connecting region 9 are aligned flush. The plug insert 5 can be fastened to the holding frame 4 by means of through-going holes 11, 13, 15 by means of a fastening element, for example a screw.

Figure 4:
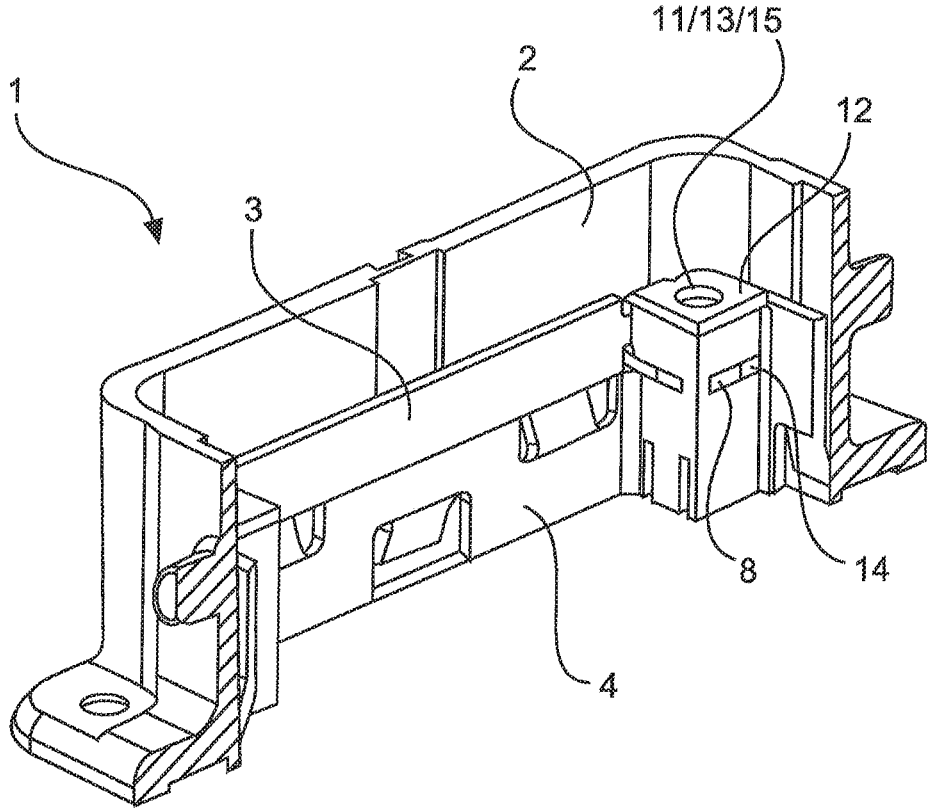
FIG. 4 illustrates a perspective sectional view of a plug connector without a plug insert.

A connecting region 9 is illustrated in FIG. 4 in a perspective sectional view of a plug connector without a plug insert. The manner in which the holding frame 4 is inserted in a housing 2 is evident. The connecting regions 9 form the corner points in the housing 2 and are used to receive and fasten a plug insert 5.

Figure 5:
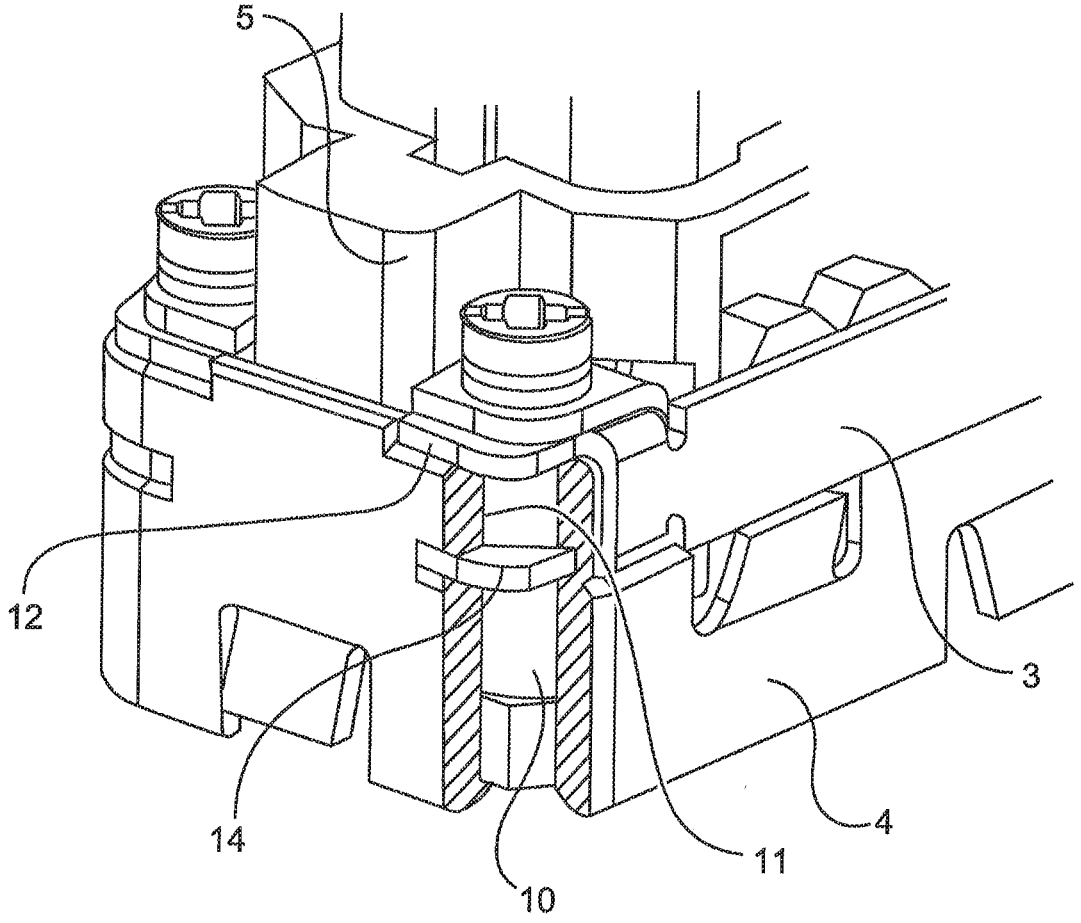
FIG. 5 illustrates a perspective part sectional view of a connecting region of a holding frame.

FIG. 5 illustrates a perspective part sectional view of a connecting region 9 of a holding frame 4, wherein this figure renders possible a view of the interior of the connecting region 9. For this purpose, a sectional view of the holding frame 4 is illustrated in the region of the connecting region 9.

The through-going hole 11 in the connecting region 9 and also the slot 8 in which the link 14 of the protective conductor bridge 3 is inserted are evident. The link 12 of the protective conductor bridge 3 lies in the upper region on the connecting region 9.

A screwing sleeve 10 is provided in the through-going hole 11 of the connecting region 9, said screwing sleeve entirely filling the through-going hole 11. The screwing sleeve engages through the through-going hole 15 of the protective conductor bridge 3, as a result of which said screwing sleeve is secured against falling out.

The screwing sleeve 10 simultaneously makes electrical contact with the links 12 in the upper region. The plug insert 5 and the link 12 is screwed to the screwing sleeve 10 by means of a screw. In the lower region, the screwing sleeve 10 comprises a multi-edged embodiment thereby preventing said screwing sleeve from rotating in the through-going hole 11 during the screwing procedure.

LIST OF REFERENCE NUMERALS

1 Plug connector
2 Housing
3 Protective conductor bridge
4 Holding frame
5 Plug insert
6 Fastening means
7 Latching means
8 Slot
9 Connecting region
10 Screwing sleeve
11 Through-going hole
12 Link
13 Through-going hole
14 Link
15 Through-going hole

The invention claimed is:

1. A plug connector for mechanically and electrically connecting to a corresponding mating plug connector, said plug connector comprising a housing, a protective conductor bridge, a holding frame and a plug insert, wherein the holding frame is held on the housing, the holding frame comprises at least one connecting region for connecting to the plug insert, and the plug insert is held on the at least one connecting region, wherein the protective conductor bridge is inserted laterally into the holding frame, wherein the at least one connecting region is embodied so as to produce a screw connection to the plug insert, the at least one connecting region comprises a first through-going hole, the protective conductor bridge comprises at least one link having a second through-going hole, and the second through-going hole is aligned to the first through-going hole wherein the protective conductor bridge includes a link arranged in a slot in the holding frame, and wherein the protective conductor bridge comprises two pairs of latches that are embodied on the axial end regions of said protective conductor bridge.

2. The plug connector as claimed in claim 1, wherein the first through-going hole is embodied with an inner thread.

3. The plug connector as claimed in claim 1, wherein a screwing sleeve is inserted in the holding region in the connecting region.

4. The plug connector as claimed in claim 3, wherein the screwing sleeve is produced from metal.

5. The plug connector as claimed in claim 1, wherein the protective conductor bridge comprises at least one pair of parallel links having in each case a second and third through-going hole, and the second and third through-going holes are aligned.

6. The plug connector as claimed in claim 1, wherein the second of the links lies on the connecting region of the holding frame.

7. The plug connector as claimed in claim 1, wherein the protective conductor bridge comprises two pairs of latches that are embodied on the axial end regions of said protective conductor bridge.

8. The plug connector as claimed in claim 6, wherein the protective conductor bridge comprises two pairs of latches that are embodied on the axial end regions of said protective conductor bridge.

9. The plug connector as claimed in claim 1, wherein the holding frame comprises a fastener for connecting the holding frame to the housing.

10. The plug connector as claimed in claim 9, wherein the fastener comprises a latch device for engaging with a corresponding latch device of the housing.

11. The plug connector as claimed in claim 1, wherein the protective conductor bridge is produced as one part from a metal sheet.

12. The plug connector as claimed in claim 1, wherein the housing is produced from synthetic material.

13. The plug connector as claimed in claim 1, wherein the holding frame is produced from synthetic material.

14. A plug connector for mechanically and electrically connecting to a corresponding mating plug connector, said plug connector comprising a housing, a protective conductor bridge, a holding frame and a plug insert, wherein the holding frame is held on the housing, the holding frame comprises at least one connecting region for connecting to the plug insert, and the plug insert is held on the at least one connecting region, wherein the protective conductor bridge is inserted laterally into the holding frame, wherein the at least one connecting region is embodied so as to produce a screw connection to the plug insert, the at least one connecting region comprises a first through-going hole, the protective conductor bridge comprises at least one link having a second through-going hole, and the second through-going hole is aligned to the first through-going hole, wherein the second of the links lies on the connecting region of the holding frame, and wherein the protective conductor bridge comprises two pairs of latches that are embodied on the axial end regions of said protective conductor bridge.

15. The plug connector as claimed in claim 14, wherein the first through-going hole is embodied with an inner thread.

16. The plug connector as claimed in claim 14, wherein a screwing sleeve is inserted in the holding region in the connecting region.

17. The plug connector as claimed in claim 16, wherein the screwing sleeve is produced from metal.

18. The plug connector as claimed in claim 14, wherein the protective conductor bridge comprises at least one pair of parallel links having in each case a second and third through-going hole, and the second and third through-going holes are symmetrical in a circular manner.

19. The plug connector as claimed in claim 14, wherein the holding frame comprises a fastener for connecting the holding frame to the housing.

20. The plug connector as claimed in claim 19, wherein the fastener comprises a latch device for engaging with a corresponding latch device of the housing.

21. The plug connector as claimed in claim 14, wherein the protective conductor bridge is produced as one part from a metal sheet.

22. The plug connector as claimed in claim 14, wherein the housing is produced from synthetic material.

23. The plug connector as claimed in claim 14, wherein the holding frame is produced from synthetic material.

* * * * *